US011666187B2

(12) United States Patent
Pryor

(10) Patent No.: US 11,666,187 B2
(45) Date of Patent: Jun. 6, 2023

(54) ROLLED MATERIAL DISPENSER SPINDLE STABILIZER ASSEMBLY

(71) Applicant: Pryor Knowledge Systems, Inc., Bloomfield Hills, MI (US)

(72) Inventor: Roger W. Pryor, Bloomfield Hills, MI (US)

(73) Assignee: PRYOR KNOWLEDGE SYSTEMS, INC., Bloomfield Hills, MI (US)

( * ) Notice: Subject to any disclaimer, the term of this patent is extended or adjusted under 35 U.S.C. 154(b) by 78 days.

(21) Appl. No.: 17/344,142

(22) Filed: Jun. 10, 2021

(65) Prior Publication Data

US 2022/0395145 A1 Dec. 15, 2022

(51) Int. Cl.
*A47K 10/38* (2006.01)

(52) U.S. Cl.
CPC ..... *A47K 10/38* (2013.01); *A47K 2010/3863* (2013.01)

(58) Field of Classification Search
CPC ..... A47K 10/38; A47K 10/40; A47K 2010/3863; B65H 75/02; B65H 75/18
See application file for complete search history.

(56) References Cited

U.S. PATENT DOCUMENTS 1,817,897 A * 8/1931 Johnson ..... A47K 10/38 242/565
2,571,321 A * 10/1951 Wettley ..... A47K 10/40 242/599.4
2,699,903 A * 1/1955 Montgomery ..... A47K 10/38 242/422.4
2,876,960 A * 3/1959 Glaner ..... A47K 10/22 242/612
3,145,940 A * 8/1964 Henry ..... A47K 10/40 384/220
3,321,149 A * 5/1967 Andersen ..... B41J 15/02 346/136
4,564,148 A * 1/1986 Wentworth ..... A47K 10/38 242/561
5,758,843 A * 6/1998 Ongaro ..... A47K 10/3836 242/563.2
6,308,910 B1 * 10/2001 Booth ..... A47K 10/40 242/565
7,416,153 B1 * 8/2008 Dervin ..... A47K 10/40 242/599.3
7,546,974 B1 * 6/2009 Bailes ..... B60R 7/043 242/588

(Continued)

*Primary Examiner* — William A. Rivera
(74) *Attorney, Agent, or Firm* — John A. Miller; Shumaker, Loop & Kendrick, LLP

(57) ABSTRACT

A spindle stabilizer assembly for use in connection with a rolled material dispenser that dispenses a rolled material. The spindle stabilizer assembly includes a spindle having a larger diameter part and a smaller diameter part, where the smaller diameter part is partially inserted into the larger diameter part and is slidable relative thereto against the bias of a spring. Strips of tape are axially formed to the larger diameter part and the larger diameter part is slid into a stabilizing tube, where the tape frictionally slows the rotation between the spindle and the tube. A friction engagement is provided between an outer diameter of the tube and the rolled material that allows the rolled material to rotate relative to the tube under a reasonable force so that the rolled material can be easily torn off the roll.

19 Claims, 1 Drawing Sheet

(56) References Cited

U.S. PATENT DOCUMENTS

| | | | | |
|---|---|---|---|---|
| 8,096,495 | B2 * | 1/2012 | Billman | B65H 75/185 242/598.3 |
| D878,079 | S * | 3/2020 | Briden | D6/523 |
| D915,100 | S * | 4/2021 | Briden | D6/523 |
| 2007/0210206 | A1 * | 9/2007 | Nip | A47K 10/3836 242/597.7 |
| 2010/0084503 | A1 * | 4/2010 | Burgess | A47K 10/40 242/565 |
| 2018/0014700 | A1 * | 1/2018 | Rickert | A47K 10/16 |
| 2018/0199768 | A1 * | 7/2018 | Paladino | A47K 10/38 |

* cited by examiner

ROLLED MATERIAL DISPENSER SPINDLE STABILIZER ASSEMBLY

BACKGROUND

Field

This disclosure relates generally to a spindle stabilizer assembly for allowing a rolled material to be easily dispensed from the roll and, more particularly, to a spindle stabilizer assembly including a stabilizer tube for allowing a rolled material to be easily dispensed from the roll.

Discussion of the Related Art

Certain materials, such as paper towels, toilet paper, food wrap, metal foil, etc., sometimes come as a rolled material wound on a tube. The tube is sometimes inserted onto a spindle associate with a rolled material dispenser that may be mounted to a fixture to allow the material to be unwound from the roll and torn off the roll for use. Generally, the inner diameter of the tube is significantly larger than the outer diameter of the spindle, and thus there is little friction between the rolled material and the spindle, which allows for the easy rotation of the rolled material relative to the spindle and easy replacement of the rolled material once it has been used. However, this easy rotation of the rolled material relative to the spindle makes it more difficult to tear the material from the roll, because the tearing action could cause the roll to rotate faster on the spindle, which could lead to certain frustration and too much of the material being used, possibly resulting in the break-up of marriages. Improvements can be made.

SUMMARY

The following discussion discloses and describes a spindle stabilizer assembly for use in connection with a rolled material dispenser that dispenses a rolled material. The spindle stabilizer assembly includes a spindle having a larger diameter part and a smaller diameter part, where the smaller diameter part is partially inserted into the larger diameter part and is slidable relative thereto against the bias of a spring. Strips of tape are axially formed to the large diameter part and the larger diameter part is slid into a stabilizing tube, where the tape frictionally slows the rotation between the spindle and the tube. A friction engagement is provided between an outer diameter of the tube and the rolled material that allows the rolled material to rotate relative to the tube under a reasonable force so that the rolled material can be easily torn off the roll.

Additional features of the disclosure will become apparent from the following description and appended claims, taken in conjunction with the accompanying drawings.

DETAILED DESCRIPTION OF THE EMBODIMENTS

The following discussion of the embodiments of the disclosure directed to a spindle stabilizer assembly for allowing a rolled material to be easily dispensed from the roll is merely exemplary in nature, and is in no way intended to limit the disclosure or its applications or uses.

Figure 1:
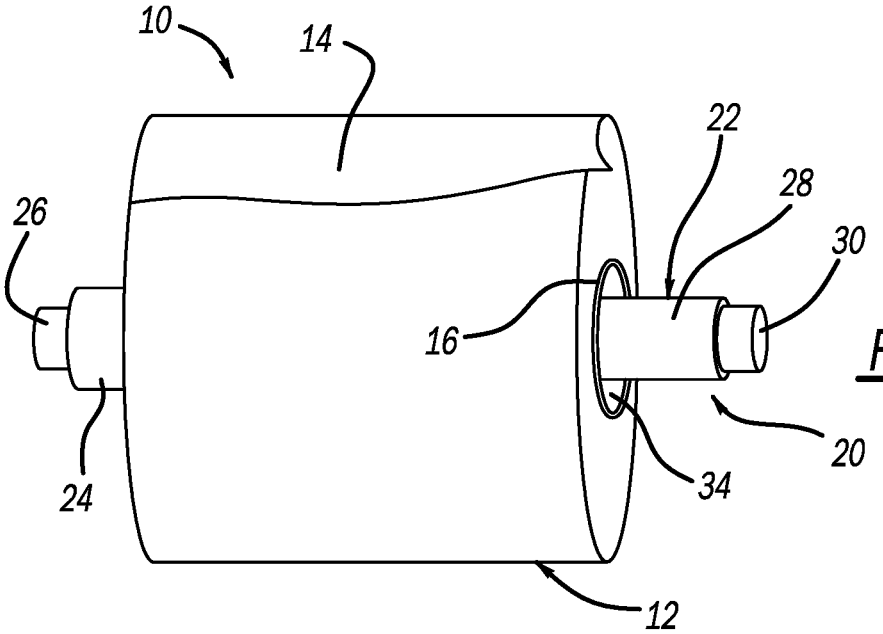
FIG. 1 is an isometric view of a rolled material dispenser including a spindle stabilizer assembly.

FIG. 1 is an isometric view of a rolled material dispenser 10 including a roll 12 of material 14, such as toilet paper, paper towel, etc., having a central tube 16, such as a cardboard tube, on which the material 14 is wound. A spindle stabilizer assembly 20 including a spindle 22 extends through the tube 16 and supports the roll 12. The spindle 22 includes a larger diameter part 24 having a mounting nub 26 and a smaller diameter part 28 having a mounting nub 30, where the nubs 26 and 30 allow the assembly 10 to be mounted to a fixture (not shown). The smaller diameter part 28 is partially inserted into the larger diameter part 24, and a spring (not shown) is inserted into the larger diameter part 24 and the smaller diameter part 28. The smaller diameter part 28 can be pushed into the larger diameter part 24 against the bias of the spring to remove the dispenser 10 from the fixture, where the bias of the spring maintains the dispenser 10 secured to the fixture. The description and operation of the dispenser 10 so far is conventional and well known.

Figure 2:
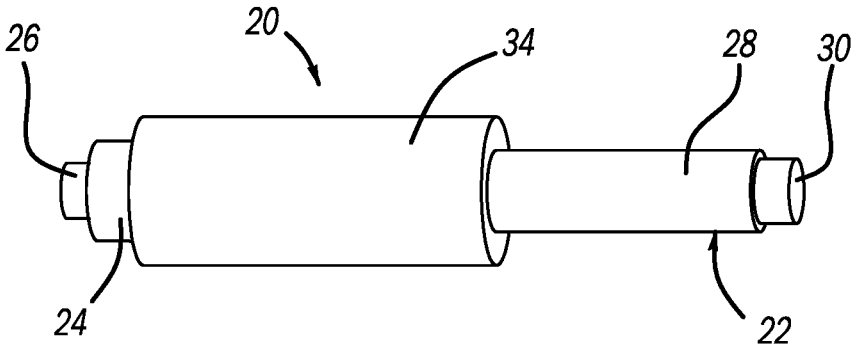
FIG. 2 is an isometric view of the spindle stabilizer assembly separated from the rolled material dispenser.
Figure 3:
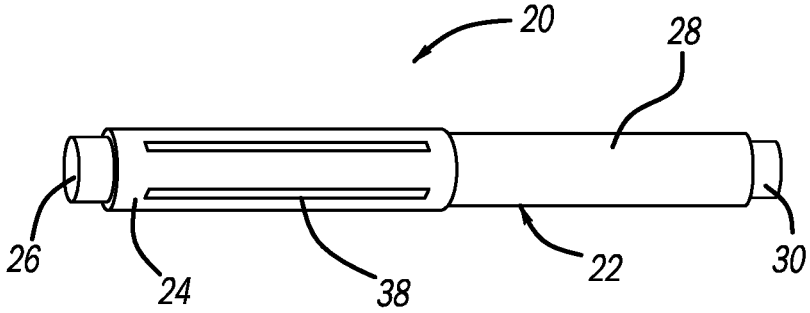
FIG. 3 is an isometric view of the spindle stabilizer assembly with a stabilizer tube removed to show strips of tape formed to the spindle.
Figure 4:
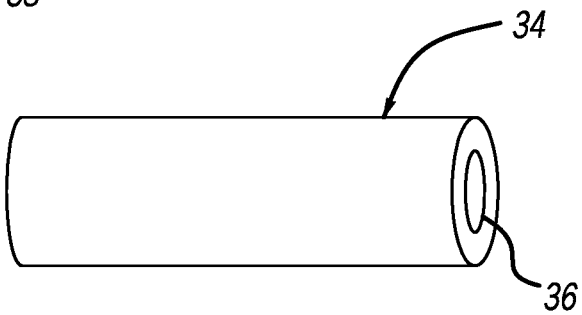
FIG. 4 is an isometric view of the stabilizer tube separated from the spindle stabilizer assembly.

FIG. 2 is an isometric view of the spindle stabilizer assembly 20 separated from the rolled material dispenser 10. The assembly 20 includes a stabilizer tube 34 having a central bore 36 where the larger diameter part 24 extends through the bore 36. The tube 34 can be made of any suitable inexpensive and lightweight resilient material, such as foam. FIG. 3 is an isometric view of the stabilizer assembly 20 with the tube 34 removed and FIG. 4 is an isometric view of the tube 34 separated from the assembly 20. In this non-limiting embodiment, the length of the tube 34 is about the same length as the larger diameter part 24. The outer diameter of the tube 34 is selected so that it fits snugly within the tube 16 and still allows the roll 12 to rotate on the tube 34 under a reasonable force. A number of strips of tape 38, for example, three strips of removable foam tape, are secured to an outer surface of the larger diameter part 24 along its axis, as shown. The diameter of the bore 36 is selected so that the tube 34 makes a frictional sliding connection to the strips of tape 38 so that the tube 34 rotates slowly relative to the spindle 22 as the roll 12 frictionally slides relative to the tube 34. Therefore, the material 14 can be unwound from the roll 12 under a reasonable force as the roll 12 rotates relative to the surface of the tube 34, and the friction engagement between the tube 16 and the tube 34 is enough so that the material 14 can easily be torn off the roll 12. Further, when the material 14 has been completely used, the tube 16 can be easily slid off the tube 34 and a new roll can be easily slid onto the tube 34.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A spindle stabilizer assembly for use in connection with a rolled material dispenser that dispenses a rolled material, said assembly comprising:

a stabilizing tube; and a spindle including a larger diameter part and a smaller diameter part, where the smaller diameter part is partially inserted into the larger diameter part and is slidable relative thereto, said larger diameter part including a least one strip of tape formed to its outer surface and being inserted into the stabilizing tube so that the at least one strip of tape allows rotation, but prevents fast rotation of the spindle relative to the tube, wherein a friction engagement is provided between an outer diameter of the tube and the rolled material that allows the rolled material to rotate relative to the tube under a reasonable force so that the rolled material can be easily torn off the roll.

2. The assembly according to claim 1 wherein the stabilizing tube is a foam tube.

3. The assembly according to claim 1 wherein the stabilizing tube is approximately the same length as the larger diameter part.

4. The assembly according to claim 1 wherein the at least one strip of tape is at least one strip of foam tape.

5. The assembly according to claim 1 wherein the at least one strip of tape is three strips of tape.

6. The assembly according to claim 1 wherein the at least one strip of tape extends along an axis of the larger diameter part.

7. The assembly according to claim 1 wherein the rolled material is toilet paper.

8. The assembly according to claim 1 wherein the rolled material is paper towel.

9. The assembly according to claim 1 wherein the rolled material is food wrap.

10. The assembly according to claim 1 wherein the rolled material is metal foil.

11. A spindle stabilizer assembly for use in connection with a toilet paper roll dispenser that dispenses toilet paper, said assembly comprising:

a foam stabilizing tube; and a spindle including a larger diameter part and a smaller diameter part, where the smaller diameter part is partially inserted into the larger diameter part and is slidable relative thereto, said larger diameter part including a plurality of strips of tape formed to its outer surface and being inserted into the stabilizing tube so that the strips of tape allow rotation, but frictionally slow the rotation of the spindle relative to the tube, wherein a friction engagement is provided between an outer diameter of the tube and the toilet paper roll that allows the toilet paper roll to rotate relative to the tube under a reasonable force so that the toilet paper can be easily torn off the roll.

12. The assembly according to claim 11 wherein the stabilizing tube is approximately the same length as the larger diameter part.

13. The assembly according to claim 11 wherein the plurality of strips of tape is three strips of tape.

14. The assembly according to claim 11 wherein the strips of tape extend along an axis of the larger diameter part.

15. The assembly according to claim 11 wherein the strips of tape are strips of foam tape.

16. A spindle stabilizer assembly for use in connection with a rolled material dispenser that dispenses a rolled material, said assembly comprising:

a stabilizing tube; and a spindle including a larger diameter part and a smaller diameter part, where the smaller diameter part is partially inserted into the larger diameter part and is slidable relative thereto, said larger diameter part including a plurality of strips of spaced apart foam tape formed to its outer surface and extending along an axis of the larger diameter part, said larger diameter part being inserted into the stabilizing tube so that the strips of tape allow rotation, but prevent fast rotation of the spindle relative to the tube, wherein a friction engagement is provided between an outer diameter of the tube and the rolled material that allows the rolled material to rotate relative to the tube under a reasonable force so that the rolled material can be easily torn off the roll.

17. The assembly according to claim 16 wherein the stabilizing tube is approximately the same length as the larger diameter part.

18. The assembly according to claim 16 wherein the plurality of strips of tape is three strips of tape.

19. The assembly according to claim 16 wherein the rolled material is selected from the group consisting of toilet paper, paper towel, food wrap and metal foil.

* * * * *